US006009811A

United States Patent [19]

Newman et al.

[11] Patent Number: 6,009,811

[45] Date of Patent: Jan. 4, 2000

[54] CHARGE ASSEMBLY FOR A PIPE-COUPLING CUTTING DEVICE

[76] Inventors: Frederic M. Newman, 1618 West Deagan, Midland, Tex. 79703; Bobby R. Ford, 5505 Finian La., Forthworth, Tex. 76180

[21] Appl. No.: 08/942,749

[22] Filed: Oct. 2, 1997

Related U.S. Application Data

[63] Continuation-in-part of application No. 08/734,355, Oct. 21, 1996, Pat. No. 5,720,344.

[51] Int. Cl.[7] ..... F42B 3/00

[52] U.S. Cl. ..... 102/312; 102/313; 102/319

[58] Field of Search ..... 102/312, 313, 102/319

[56] References Cited

U.S. PATENT DOCUMENTS

| | | | |
|---|---|---|---|
| 2,758,543 | 8/1956 | Grandin | 102/319 X |
| 3,964,553 | 6/1976 | Basham et al. | 175/4.51 |
| 4,122,899 | 10/1978 | Brieger | 102/319 X |
| 4,208,966 | 6/1980 | Hart | 102/313 X |
| 4,438,810 | 3/1984 | Wilkinson | 175/4.51 X |
| 4,875,413 | 10/1989 | Christopher et al. | 102/312 X |
| 4,919,050 | 4/1990 | Dobrinski et al. | 102/313 X |
| 5,582,248 | 12/1996 | Estes | 175/4.51 |

*Primary Examiner*—Peter A. Nelson
*Attorney, Agent, or Firm*—Charles D. Gunter, Jr.

[57] ABSTRACT

A charge assembly for use in a cutter for splitting couplings used in joining together lengths of buried pipe is provided that allows several explosive charge segments to be used instead of a single explosive charge. The smaller explosive charge segments utilize less explosive material which complies with applicable shipping regulations. The charge assembly has an elongate charge housing with an open interior. At least two linear charge segments are longitudinally aligned in an abutting relationship with the other within the housing interior. The linear charge segments may be formed from an explosive core encased within a metal sheath. A pair of longitudinally spaced charge abutment members may be mounted within the housing interior, with the abutment members engaging the aligned charge segments at opposite ends. One of the abutment members includes a housing end closure. The abutment members may be provided with biasing means for engaging the longitudinally aligned charge segments and urging the charge segments into the abutting relationship. Further, a charge segment retainer, which includes a pair of longitudinally extending rails, may be provided and located within the interior of the housing. The charge retainer engages the charge segments for lateral retention of the charge segments within the interior of the charge housing.

19 Claims, 6 Drawing Sheets

CHARGE ASSEMBLY FOR A PIPE-COUPLING CUTTING DEVICE

This is a continuation in part of application Ser. No. 08/734,355, filed Oct. 21, 1996, entitled Method of Longitudinally Splitting a Pipe Coupling Within a Wellbore, and now U.S. Pat. No. 5,720,344.

BACKGROUND OF THE INVENTION

1. Field of the Invention

The subject invention generally pertains to methods of removing pipe from a wellbore, and more specifically to devices used in explosively splitting a coupling longitudinally, and still more specifically to charge assemblies that are used in such devices.

2. Description of the Related Art

It is often desirable to sever, split or otherwise cut a string of tubing or casing to recover the pipe from wellbores. In cutting pipe within a wellbore, pipe restrictions are often encountered. These restrictions may be in the form of a packer or fishing spear placed within the pipestring for the purpose of retrieval, or they may be of natural causes such as scale, paraffin, collapsed pipe, or smaller inner string of pipe stuck within the larger diameter pipe that is to be cut. Restrictions inhibit the use of present cutters that require a full opening or full inside diameter to achieve an effective cut. Other folding or spring-loaded devices have been developed to run through these restrictions, but these devices have met with little commercial success due to their mechanical complexity and high failure rate.

Over the years a variety of methods for cutting pipe in a wellbore have been developed. Some of these include chemical cuts, backoff shots, nitroglycerin, and various forms of shaped charges.

Chemical cuts are extraordinarily expensive and require the outer edge of the cutting device to be immediately adjacent (within a fraction of an inch) to the pipe being cut. By its design, the outer diameter of the chemical cutter head must be very close to the inside diameter of the pipe being cut. This limits the use of the chemical cutter in tubulars that have a restriction above the cutting point. Due to the "piston effect", the cutter floats into the hole, thereby slowing down the costly process of cutting and retrieving pipe from the ground.

Backoff shots are another way of separating the pipe within a wellbore. This process is simply placing an explosive device across a coupling and putting left-hand or reverse torque the string of pipe to be backed off. When the proper reverse torque is in the pipe, the explosive is discharged thereby creating shock waves at that point. The pipe then simply unscrews. The limitation of this method of pipe retrieval is that there is no guarantee as to where the pipe might unscrew.

The use of nitroglycerin is another method of severing the pipe at a coupling. This method, although simple and economical, simply blows up the tubulars and its immediate environment. Better said, it makes a mess of the pipe that is pulled and left in the ground. The use of nitroglycerin is not environmentally sound in that it prohibits or limits the reentering of this wellbore for future use.

There are various forms of radial-shaped charges in use and several of these products offer excellent cuts, however they have two inherent problems. As in the chemical cutter, the outside diameter of the radial cutter assembly must be very close to the target or inside the diameter of the pipe being cut. This design limitation is due to the shaped charge design phenomenon of "standoff" whereby the distance between the charge and the target is crucial to its performance. Another resultant problem resulting from the large outside diameter of the cutter is that it has a "floating effect" as it is lowered into the hole. Additional weights are required to help push it into the hole. By-in-large though, the biggest drawback to the use of the radial charge is that it cannot be run through any significant restriction or constriction in the pipe. In other words, one must have a full opening from the surface to the required cutting depth.

The remaining option for cutting downhole tubulars is the use of the linear-shaped charge. As in the radial charge, the standoff phenomenon has dictated the design of various devices using the linear form of a shaped charge. Several of these devices use mechanical springs, unfolding charges or remotely extendible frameworks to properly position the charge with the proper design standoff against the coupling to be cut. Again, the complexity of such mechanisms have proved to be unreliable and impractical when exposed to the severe pressures and temperatures of downhole environments.

The amount of explosive in the linear charges needed for effectively cutting, downhole pipes and couplings is generally too great to allow them to be shipped by air and economically shipped by ground transportation. This is due to certain government regulations that prohibit the air transportation of certain classes of explosives and place stringent requirements on those transported along roadways. As slower, more expensive, modes of transporting these explosives must be used, this increases the shipping time and costs and may often result in long and costly delays.

SUMMARY OF THE INVENTION

A charge assembly for use in a cutter for splitting couplings used in joining together lengths of buried pipe is provided with an elongate charge housing having an open interior. At least two linear charge segments are longitudinally aligned in an abutting relationship one with the other within the housing interior. The linear charge segments may be formed from an explosive core encased within a metal sheath. A pair of longitudinally spaced charge abutment members may be mounted within the housing interior, with the abutment members engaging the aligned charge segments at opposite ends. One of the abutment members includes a housing end closure. The abutment members may be provided with biasing means for engaging the longitudinally aligned charge segments and urging the charge segments into the abutting relationship. Further, a charge segment retainer, which includes a pair of longitudinally extending rails, may be provided and located within the interior of the housing. The charge retainer engages the charge segments for lateral retention of the charge segments within the interior of the charge housing.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Although the invention has been described with reference to specific embodiments, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

Figure 1:
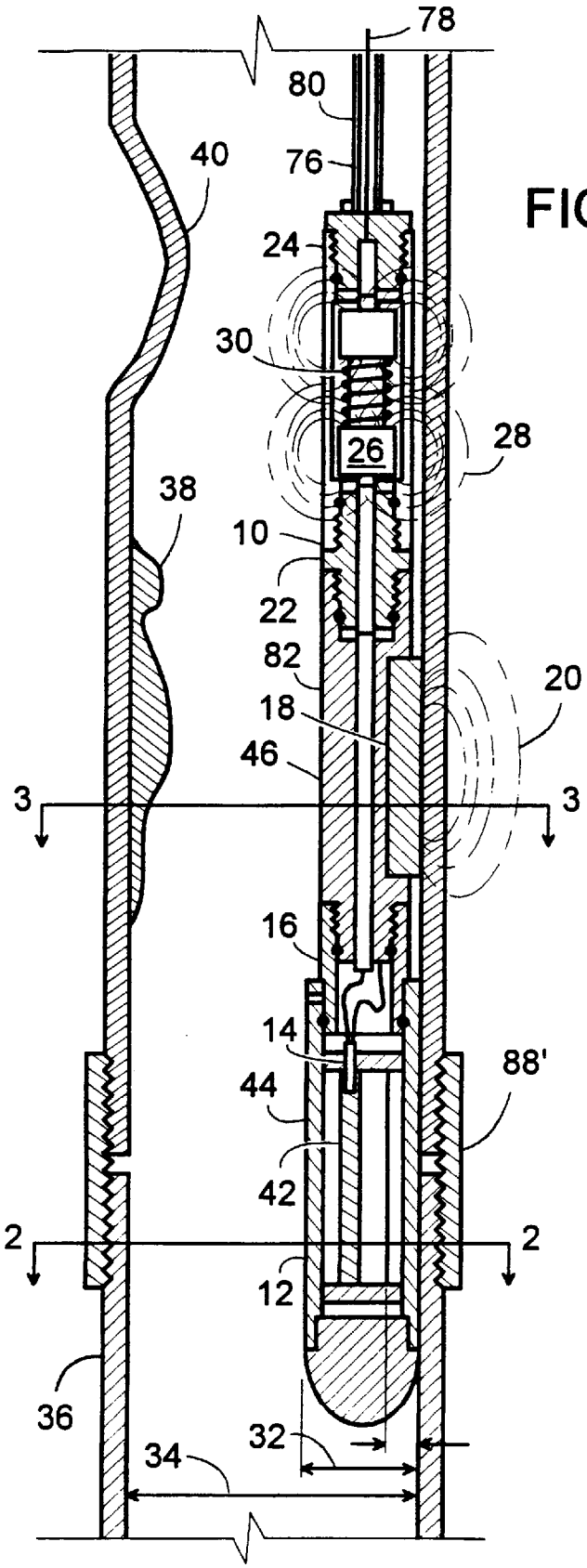
FIG. 1 is a cross-sectional view of a linear pipe coupling cutter constructed in accordance with the invention.

A coupling cutter 10 of FIG. 1 includes a longitudinal charge assembly 12, an electrically ignitable cap 14, a first adapter 16, a first magnet 18 having a first magnetic field 20, a second adapter 22, and a coupling locator 24. Coupling locator 24 includes a second magnet 26 having a second magnetic field 28 extending across a coil 30. Cutter 10 has a major diameter 32 that is less than half of a nominal inside diameter 34 of a pipe 36, so that cutter 10 can readily travel through pipe 36 past various obstacles 38 and other restrictions 40 including, but not limited to, scale, paraffin, or collapsed pipe.

Figure 2:
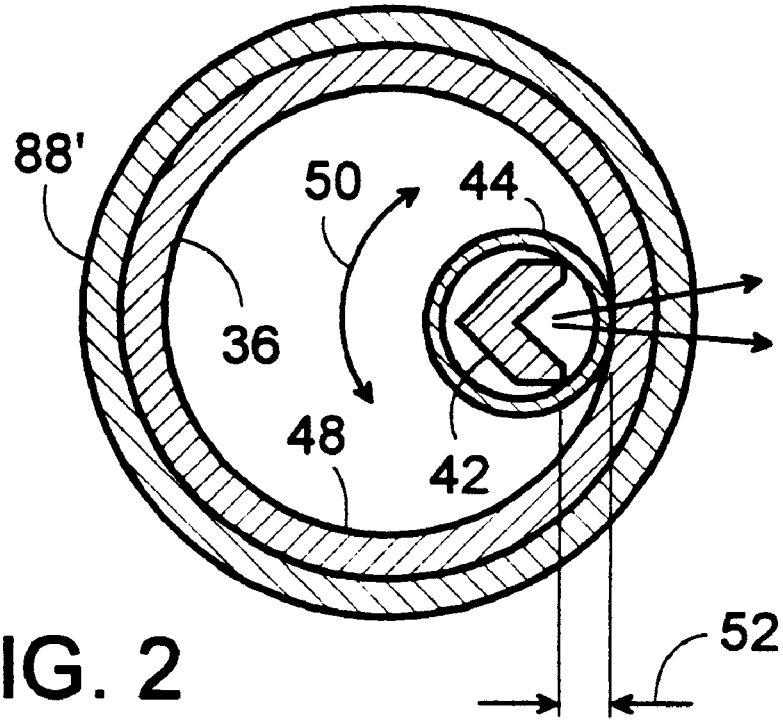
FIG. 2 is a cross-sectional view of the cutter taken along line 2—2 of FIG. 1.

A cross-sectional view of longitudinal charge assembly 12 is shown in FIG. 2. Longitudinal charge assembly 12 includes a single, longitudinal charge 42 contained within an aluminum housing 44. Housing 44, as well as all other external structural components 82 of cutter 10, must be able to withstand hydrostatic pressures exceeding 5,000 psi. The term "longitudinal charge" as used herein refers to an explosive charge whose length is greater than its width as opposed to "point" and "circumferential" shaped charges. Details of shaped charges, such as longitudinal charge 42, are explained in U.S. Pat. Nos. 5,501,154; 4,693,181; 2,587,244; 4,498,367; and 2,605,704 all of which are specifically incorporated by reference herein.

Figure 3:
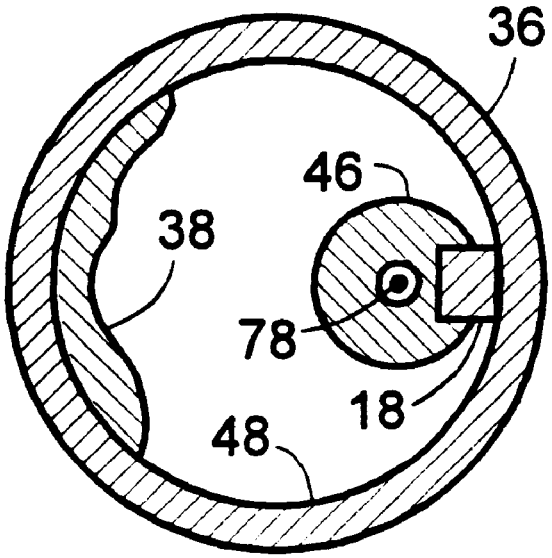
FIG. 3 is a cross-sectional view of the cutter taken along line 3—3 of FIG. 1.

A cross-sectional view of magnet 18 is shown in FIG. 3. Magnet 18 is a conventional magnet attached to a non-magnetic housing 46. Its magnetic field 20 is not strong enough to support the entire weight of cutter 10. If it were, it would prevent one from lowering cutter 10 down through pipe 36. Magnetic field 20 is, however, strong enough to draw coupling cutter 10 against an inner wall 48 of pipe 36. This establishes a proper rotational alignment 50 and radial alignment 52 of longitudinal charge 42 relative to inner wall 48, as shown in FIG. 2. The term "radial alignment" used herein is often referred to in the industry as "standoff" which is the critically important facial distance between the face of the charge and its target.

Figure 4:
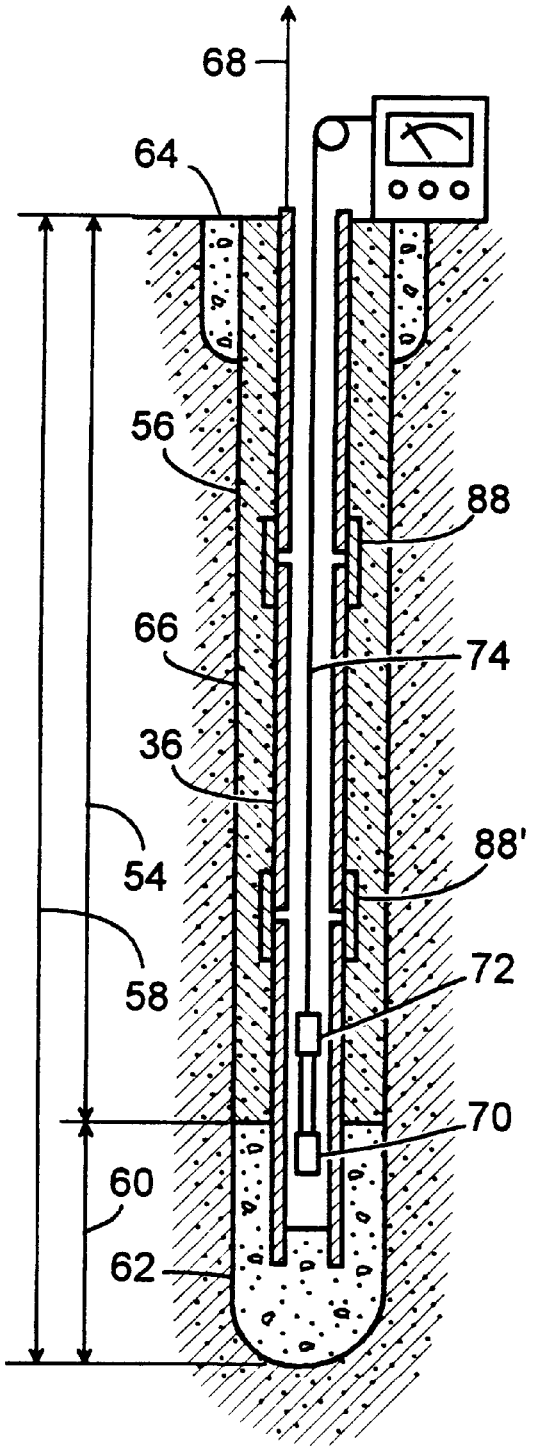
FIG. 4 shows the step of locating the cement depth.

Referring to FIG. 4, in operation, typically one first determines a cement depth 54 of a wellbore 56. In this example, wellbore 56 extends 10,000 feet deep 58 with 3,000 feet of its lower portion 60 set in cement in place at an upper portion 64. Most of pipe 36 is surrounded by mud 66. Cement depth 54 can be determined several different ways. One can determine cement depth 54 by exerting an axial force 68 on pipe 36 and calculating the pipe length (above cement) as a function of the force, strain, and the pipe's modules of elasticity and cross-sectional area. Running a cement bond log is another common method of determining cement depth 54. This method involves lowering a 20 khz sound transmitter 70 and receiver 72 that provides an electrical feedback signal 74 that varies as a function of the sound dampening characteristics of the material surrounding pipe 36. Other methods consider the volume of cement 62 using volumetric calculations, or simply guess.

Figure 5:
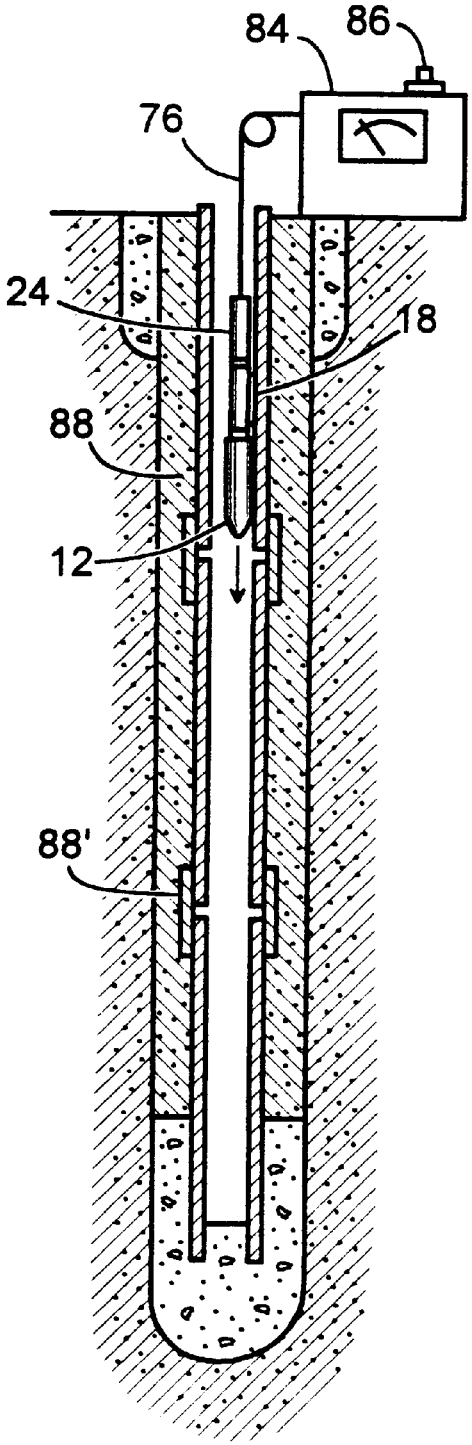
FIG. 5 shows the step of lowering the cutter into a wellbore.

Once cement depth 54 is determined, cutter 10 is lowered into pipe 36 by way of a two-conductor coaxial cable 76, as shown in FIGS. 1 and 5. One conductor 78 (center wire) is connected to one end of coil 30 and cap 14. Another conductor 80 (outer armor) is a ground connected to coil 30 and cap 14 via structural components 82 of cutter 10. Cable 76 suspends cutter 10, provides means for conveying current that ignites cap 14, and conveys a coupling location feedback signal to an instrument 84 (e.g., combination DC power supply and microampmeter). Instrument 84 senses the coupling location feedback signal and includes a switch 86 to ignite cap 14.

The coupling location feedback signal is an electrical signal induced through coil 30 upon magnetic field 28 being disturbed. Coupling locator 24 passing across a pipe coupling 88 causes the magnetic field disturbance.

Figure 6:
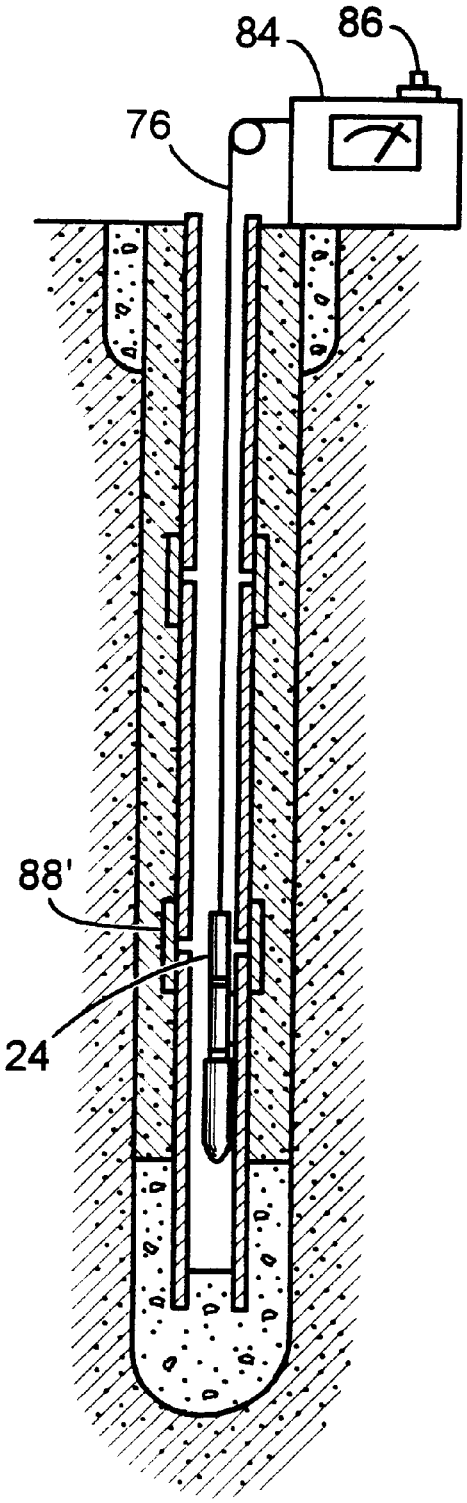
FIG. 6 shows the step of sensing the location of a pipe coupling.
Figure 7:
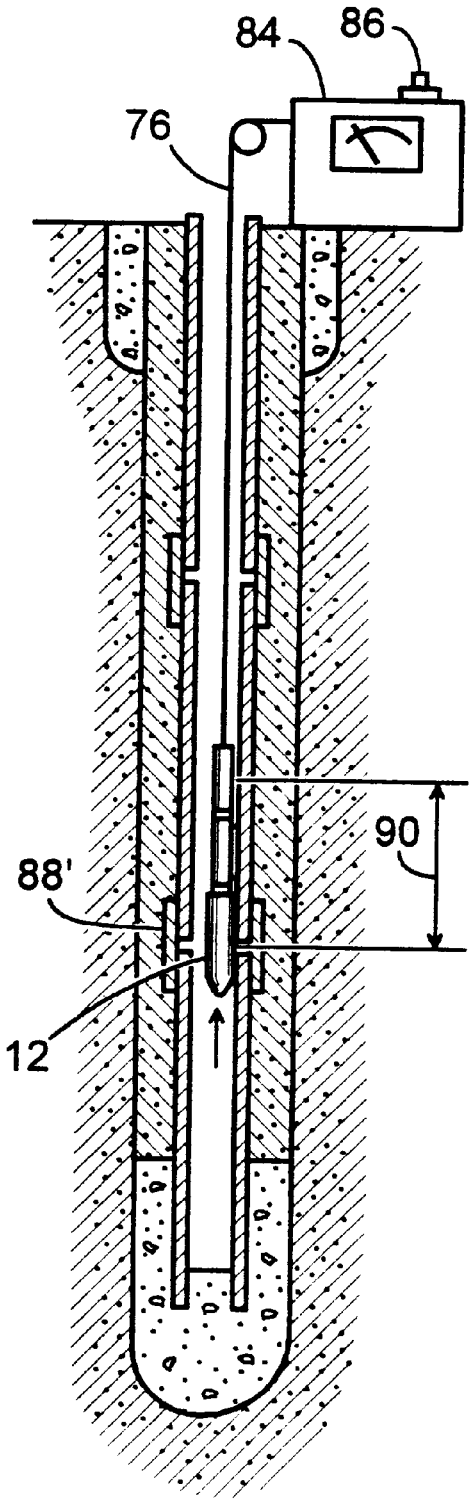
FIG. 7 shows the step of longitudinally cutting a pipe coupling.
Figure 8:
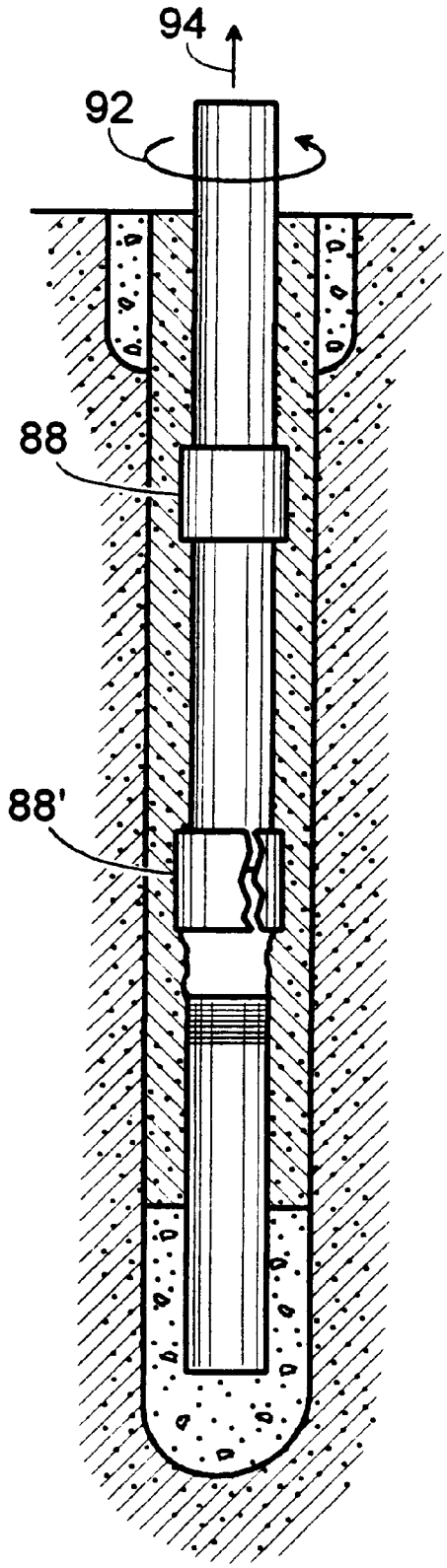
FIG. 8 shows the step of removing a string of pipes from a wellbore.

To identify the lowest coupling above cement depth 54, cutter 10 is first lowered to cement depth 54 and then raised while monitoring the coupling location feedback signal using instrument 84, as shown in FIG. 6. Once a coupling depth is identified, as indicated by the feedback signal using instrument 84, as shown in FIG. 6. Once a coupling depth is identified, as indicated by the feedback signal reaching a predetermined limit, cutter 10 is then raised a distance 90 to longitudinally align charge 42 to coupling 88' as shown in FIG. 7. At this point an operator trips switch 86 to detonate charge 42. The explosion longitudinally splits coupling 88' (FIG. 8) so that pipes 36 are radially separated and removed as indicated by arrows 92 and 94, respectively.

Figure 9:
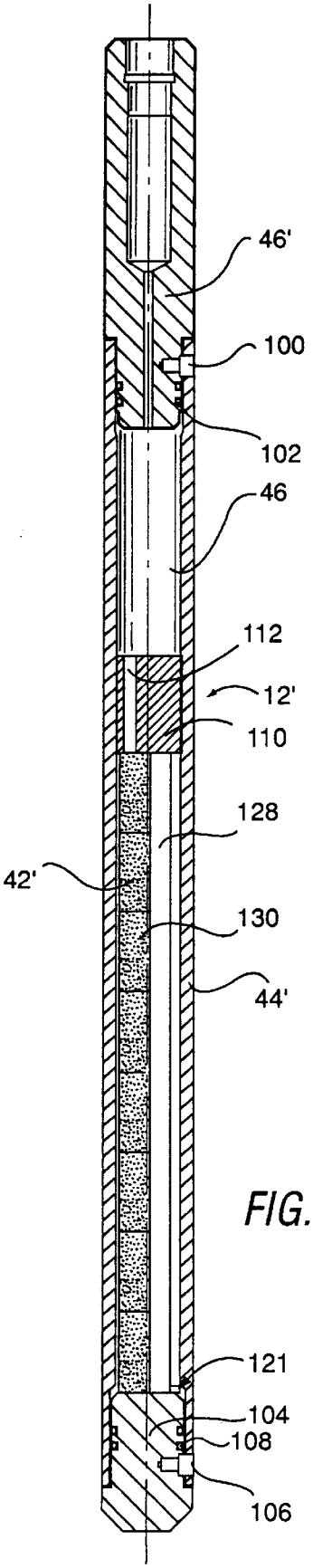
FIG. 9 is a cross-sectional view of a charge assembly of the cutter, shown with a plurality of charge segments mounted therein and constructed in accordance with the invention.
Figure 10:
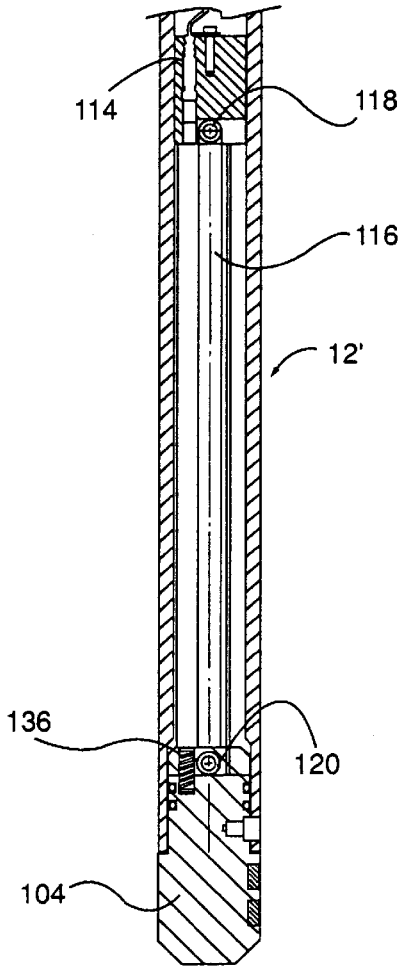
FIG. 10 is another cross-sectional view of the charge assembly of FIG. 9, shown with the charge segments removed.

Referring now to FIGS. 9–10, a charge assembly 12' is shown. The charge assembly 12' is similar to the charge assembly 12, shown in FIG. 1 with similar components designated with a prime symbol. The charge assembly includes an elongate, cylindrical charge housing 44' that defines a housing interior 96. The charge housing 44' will typically have an outer diameter of between about ⅝ inch to 2.0 inches. The charge housing interior 96 is closed at its upper end by a non-magnetic metal sub 46' and the housing 44' is held in place by means of set screw 100. A pair of O-ring seals 102 are provided with the sub 46' for effectively sealing the upper end of housing interior 96.

The lower end of the housing 44' is closed off by end plug 104. The end plug 104 extends at least partially into the housing interior 96 and is mounted to the charge housing 44' and held in place by means of set screw 106. O-ring seals 108 are also provided for sealing the lower end of housing 44'. Longitudinally spaced from the end plug 104 within the housing interior 96 is a detonator holder 110. The detonator holder 110 is sized to closely fit within the housing interior 96 and is provided with an aperture 112 for receiving detonator 114 (FIG. 10). The detonator holder 110 and end plug 104 are joined together by a pair of parallel charge retaining rails 116, 117 (FIG. 11) that extend longitudinally within the housing interior 96. The retaining rails 116 are secured at the ends to the holder 110 and end plug 104 by fasteners 118 and 120, respectively, with the end plug 104, detonator holder 110 and rails 116 forming a removable rail assembly unit 121.

Figure 11:
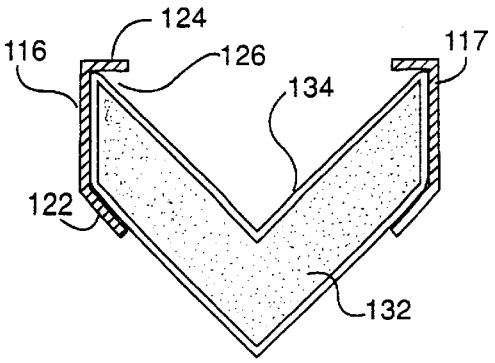
FIG. 11 is a transverse cross-sectional view of one of the charge segments held within retention rails of the charge assembly and constructed in accordance with the invention.

As can be seen more clearly in FIG. 11, each retaining rail is provided with inwardly projecting retaining lips 122, 124 that define a channel 126. When the rail assembly 121 is mounted to the charge housing 44', the spaced apart end plug 104 and detonator holder 110 within the housing interior 96 define a detonation chamber 128. A linear or longitudinal charge 42' is housed within the detonation chamber 128. The charge 42' is formed from a plurality of smaller linear charge segments 130. The linear charge segments 130 have a generally V-shaped transverse cross section, as shown in FIG. 11. Each segment 130 has an explosive core 132 surrounded along the sides by a seamless metal sheath 134. The metal sheath 134 terminates at the ends of each segment 130 so that the core material 132 is exposed at both ends of each segment 130. Suitable core materials include RDX (cyclotrimethylene trinitramine), HMX (cyclotetramethylene trinitramine), PETN (pentaerythritol tetranitrate), HNS (hexanitrostilbene) and PYX explosives and are generally known by those skilled in the art. These materials generally have detonation rates of between about 7000 to 9500 m/s at a load density of between about 1.60 and 1.85 g/cc.

The explosive core 132 of each segment 130 may have a gram load of explosive of less than about 25 grams. This amount of explosive is currently classed as a Class C explosive by the U.S. Department of Transportation so that it can be legally shipped by air transportation. It should be apparent, however, that the amount of explosive used may vary, depending upon the applicable rules and regulations regarding the shipping of explosives by aircraft. Thus, the amount of explosive used and selected for the core 132 of each segment 130 should be at or below those levels that may be legally shipped by air transportation.

The charge segments 130 are longitudinally aligned between the detonator holder 110 and the end plug 104, with each charge segment 130 abutting against the adjacent charge segments. A coiled spring 136 mounted to the upper end of the end plug 104 and projecting into the detonation chamber 128 presses against the lowermost charge segment 130 and provides an upward biasing force for urging the segments 130 against the detonator holder 110, thus maintaining the aligned charge segments 130 in a close abutting relationship. There should be little, if any, gap between the explosive material forming the core 132 of adjacent segments 130. In this way, the detonation of the aligned segments 130 forming the charge 44' will be the same as that from a single, continuous length of explosive charge. The length of the rails 116 is selected to accommodate the desired number of segments 130.

The charge assembly 12' is loaded by first loosening the set screw 106 so that the end plug 104 is freed. The rail assembly 121, with the attached detonator holder 110 and retaining rails 116, is then removed. The charge segments 130 are then loaded into the channels 126 of the retaining rails 116. The retaining rails 116 ensure that the charge segments 130 are properly aligned and also limit lateral movement of the charge segments 130. When the charge segments are loaded into the rails 116, the spring 136 should firmly press the aligned charge segments 130 against the detonator holder 110 to form a line of segments 130 forming the charge 42'. When this is done, the exposed explosive core 132 at the end of the uppermost segment 130 should be aligned with the aperture 112 of the detonator holder 110. The loaded assembly is then inserted into the charge housing 44' and the set screw 106 tightened to securely hold the end plug 104 and rail assembly 121 in place. The detonator 1 14 may then be inserted into the aperture 112 for detonation of the charge 42'. As shown in FIG. 9, there are eight charge segments 130 used to form the charge 42'. It should be apparent to those skilled in the art that the number of charge segments used may vary, depending upon the size of the charge needed.

The charge assembly of the invention is a great advantage over the prior art in that it allows several smaller charge segments to be used instead of a single larger charge. Because lower amounts of explosives are used for each charge segment, the charge segments can be manufactured and packaged to meet current rules and regulations regarding the shipping of explosives to enable the charge segments to be shipped by air transportation. This is a particular advantage in situations were fast shipping times are important. The larger charges used in prior art devices cannot be shipped by air due to the large amounts of explosive that are used.

Although the invention is described with respect to specific embodiments, modifications and changes thereto will be apparent to those skilled in the art without departing from the scope of the invention.

I claim:

1. A charge assembly for use in a cutter for splitting couplings used in joining together lengths of buried pipe, the charge assembly comprising:

an elongate charge housing defining an open housing interior;

at least two linear charge segments, each segment being longitudinally aligned in an abutting relationship with one another such that there is little or no gap between the segments within the housing open interior; and the segments thus placed forming a linear charge.

2. The charge assembly of claim 1, further comprising:

a pair of spaced apart charge abutment members mounted within the housing interior, the abutment members engaging the aligned charge segments at each of two opposing ends thereof.

3. The charge assembly of claim 2, wherein:

one of the charge abutment members includes a housing end closure for closing off one end of the charge housing.

4. The charge assembly of claim 2, wherein:

one of the charge abutment members has a biasing means for engaging the longitudinally aligned charge segments and urging the charge segments into the abutting relationship.

5. The charge assembly of claim 1, further comprising:

a charge segment retainer located within the interior of the housing, the charge segment retainer engaging the charge segments for lateral retention of the charge segments within the interior of the charge housing.

6. The charge assembly of claim 5, wherein:

the charge segment retainer includes a pair of longitudinally extending rails, each rail having a longitudinal retaining lip, the charge segments being positioned between the rails and being laterally retained therein by means of the retaining lips.

7. The charge assembly of claim 1, wherein:

each charge segment includes an explosive core encased within a metal sheath.

8. The charge assembly of claim 6, wherein:

the metal sheath is open at the ends of each charge segment to expose the explosive core.

9. The charge assembly of claim 1, wherein:

each charge segment has an explosive core selected from a group consisting of RDX, HMX, HNS, PYX and PETN explosives.

10. The charge assembly of claim 1, wherein:

each charge segment has an explosive core with a gram load of less than about 25 grams each.

11. The charge assembly of claim 2, wherein:

one of the charge abutment members is apertured to receive a detonator for detonating the charge segments.

12. The charge assembly of claim 1, wherein:

the charge housing has an outer diameter that is less than half the inner diameter of the buried pipe.

13. A charge assembly for use in splitting couplings used in joining together lengths of buried pipe, the charge assembly comprising:

an elongate charge housing having first and second ends, the charge housing defining an interior;

at least two linear charge segments, each segment being longitudinally aligned in an abutting relationship one with the other within the housing interior such that there is little or no gap between segments;

a pair of charge abutment members that are longitudinally spaced apart and located within the housing interior, the abutment members engaging the aligned charge segments at each of two opposing ends thereof, the thus placed segments forming a linear charge;

a charge segment retainer located within the interior of the housing, the charge segment retainer engaging the charge segments for lateral retention of the charge segments within the interior of the charge housing; and wherein the charge segment retainer includes a pair of longitudinally extending rails, each rail having a retaining lip, the charge segments being positioned between the rails and being laterally retained therein for sliding longitudinal movement along the longitudinally extending rails.

14. The charge assembly of claim 13, wherein:

one of the abutment members has a biasing means for engaging the longitudinally aligned charge segments and urging the charge segments into the abutting relationship.

15. The charge assembly of claim 13, wherein:

each charge segment includes an explosive core encased within a metal sheath.

16. The charge assembly of claim 15, wherein:

the metal sheath is open at the ends of each charge segment to expose the explosive core.

17. The charge assembly of claim 13, wherein:

each charge segment has an explosive core selected from a group consisting of RDX, HMX, HNS, PYX and PETN explosives.

18. The charge assembly of claim 15, wherein:

each charge segment has an explosive core with a gram load of less than about 25 grams each.

19. The charge assembly of claim 13, wherein:

one of the charge abutment members is apertured to receive a detonator for detonating the charge segments.

* * * * *